US007895813B2

(12) United States Patent
Andria et al.

(10) Patent No.: US 7,895,813 B2
(45) **Date of Patent: *Mar. 1, 2011**

(54) METHOD FOR PREPARING MATTRESSES FOR SHIPMENT

(75) Inventors: Niaina Andria, Sainte-Catherine (CA); George Itzkovitz, Hampstead (CA)

(73) Assignee: Primo International, Montreal (CA)

( * ) Notice: Subject to any disclaimer, the term of this patent is extended or adjusted under 35 U.S.C. 154(b) by 81 days.

This patent is subject to a terminal disclaimer.

(21) Appl. No.: 12/266,137

(22) Filed: Nov. 6, 2008

(65) Prior Publication Data

US 2009/0260327 A1 Oct. 22, 2009

Related U.S. Application Data

(63) Continuation of application No. 11/581,200, filed on Oct. 13, 2006, now Pat. No. 7,458,193.

(51) Int. Cl.
*B65B 63/02* (2006.01)
*B65B 5/06* (2006.01)

(52) U.S. Cl. ..... 53/399; 53/436; 53/438; 53/447; 53/449

(58) Field of Classification Search ..... 53/399, 53/436, 438, 523, 528, 529, 540, 582, 443, 53/447, 449, 526, 170, 171, 176; 206/326
See application file for complete search history.

(56) References Cited

U.S. PATENT DOCUMENTS

| | | | | |
|---|---|---|---|---|
| 1,985,163 A | | 12/1934 | Ginsberg | 226/18 |
| 2,119,956 A | | 6/1938 | McDonnell | 53/399 |
| 2,681,702 A | * | 6/1954 | Kuenn et al. | 53/443 |
| 2,700,459 A | | 1/1955 | Anspacher | 206/46 |
| 2,864,218 A | * | 12/1958 | Wilson et al. | 53/530 |
| 2,896,207 A | | 7/1959 | Wilson | 53/438 |
| 2,937,485 A | * | 5/1960 | Wall | 53/570 |
| 2,973,090 A | * | 2/1961 | Dunlap | 206/326 |
| 3,390,509 A | | 7/1968 | Kamp | 53/261 |
| 3,461,641 A | * | 8/1969 | Zubik et al. | 53/438 |
| 3,521,424 A | | 7/1970 | Wirfel | 53/24 |
| 3,541,752 A | * | 11/1970 | Ness | 53/436 |
| 3,641,726 A | * | 2/1972 | Cassina | 53/438 |
| 3,805,354 A | | 4/1974 | Guthrie | 29/700 |

(Continued)

FOREIGN PATENT DOCUMENTS

EP 0 195 755 B1 1/1991

(Continued)

OTHER PUBLICATIONS

Written Opinion and International Search Report of the International Searing Authority for International Application #PCT/CA2009/000991, international filing date Jul. 13, 2009, mailed on Apr. 15, 2010.

*Primary Examiner* — Stephen F Gerrity
(74) *Attorney, Agent, or Firm* — Burns & Levinson LLP; Jacob N. Erlich; Marlo M. Schepper

(57) ABSTRACT

A method and system for packaging multiple bedding products. The method includes compressing a stack of individual compressed and sealed mattresses between an upper shipping support and a lower shipping support and restraining subsequent expansion of the individual compressed and sealed mattresses with bands enclosing the upper and lower shipping supports and the stack of compressed and sealed mattresses.

3 Claims, 15 Drawing Sheets

U.S. PATENT DOCUMENTS

| | | | | | |
|---|---|---|---|---|---|
| 3,908,539 | A | | 9/1975 | O'Brien | 53/529 |
| 3,914,918 | A | * | 10/1975 | Laird | 53/399 |
| 4,110,954 | A | * | 9/1978 | Olsson et al. | 53/436 |
| 4,418,514 | A | * | 12/1983 | Spann | 53/436 |
| 4,711,067 | A | | 12/1987 | Magni | 53/439 |
| 4,799,350 | A | * | 1/1989 | Rias | 53/399 |
| 4,821,491 | A | | 4/1989 | Rias | 53/438 |
| 4,928,337 | A | | 5/1990 | Chauncey | 5/465 |
| 5,271,498 | A | | 12/1993 | Gillespie | 206/326 |
| 5,350,063 | A | * | 9/1994 | Berdan, II | 53/447 |
| 5,622,030 | A | | 4/1997 | Steed et al. | 53/436 |
| 5,664,408 | A | | 9/1997 | Chesterfield et al. | 53/512 |
| RE36,142 | E | | 3/1999 | Steed et al. | 53/436 |
| 5,934,041 | A | | 8/1999 | Rudolf et al. | 53/118 |
| 6,098,378 | A | | 8/2000 | Wyatt | 53/430 |
| 6,273,257 | B1 | | 8/2001 | Mossbeck | 206/497 |
| 6,467,239 | B2 | | 10/2002 | Mossbeck et al. | 53/430 |
| 6,502,375 | B2 | | 1/2003 | Resta | 53/575 |
| 6,606,839 | B1 | | 8/2003 | Suda et al. | 53/430 |
| 6,640,520 | B2 | | 11/2003 | Gecic | 53/430 |
| 6,735,923 | B1 | | 5/2004 | Resta | 53/64 |
| 6,739,107 | B1 | | 5/2004 | Lewis et al. | 53/118 |
| 6,810,643 | B1 | | 11/2004 | Gecic et al. | 53/430 |
| 6,892,448 | B2 | | 5/2005 | Gecic | 29/779 |
| 6,901,722 | B2 | | 6/2005 | Dextraze et al. | 53/399 |
| 7,017,854 | B2 | | 3/2006 | Gecic et al. | 242/530.2 |
| 7,059,101 | B2 | | 6/2006 | Dextraze et al. | 53/399 |
| 7,080,494 | B2 | * | 7/2006 | Toews | 53/399 |
| 2002/0124531 | A1 | | 9/2002 | Mossbeck et al. | 53/430 |
| 2003/0183550 | A1 | | 10/2003 | DiLiberto, Jr. | 206/524.8 |
| 2007/0204566 | A1 | * | 9/2007 | Lee | 53/436 |
| 2008/0086984 | A1 | | 4/2008 | Andria et al. | |
| 2008/0245690 | A1 | | 10/2008 | Knewtson et al. | |

FOREIGN PATENT DOCUMENTS

| | | | |
|---|---|---|---|
| GB | 2 153 327 | A | 8/1985 |
| JP | 2004010119 | | 7/2006 |
| WO | WO 2004/099004 | A1 | 11/2004 |

* cited by examiner

METHOD FOR PREPARING MATTRESSES FOR SHIPMENT

This application is a continuation of and claims the priority date of Utility Application Ser. No. 11/581,200, entitled METHOD AND SYSTEM FOR PREPARING MATTRESSES FOR SHIPMENT, filed on Oct. 13, 2006, now issued U.S. Pat. No. 7,458,193, which this application incorporates by reference in its entirety.

FIELD OF THE INVENTION

A method for packaging multiple bedding products, more particularly a method for packaging multiple compressed mattresses or futons together for sea and land transportation.

BACKGROUND OF THE INVENTION

Present methods for packaging an individual mattress or another compressible bedding product employ compression and/or application of a vacuum to ensure ease of transport of the individual mattress. Other bedding components, such as one or more pillows, a topper, a duvet or bed covering, etc, may be vacuum packed and compressed along with the mattress for shipment.

Present methods address neither mass merchant size shipments where dozens of mattresses form a shipment nor reliability issues encountered by the compressed individual mattresses during shipment. An air leak at a sealed end of the mattress packaging results in decompression of the previously compressed mattress during transport or storage. Usually, no facility is available to recompress the mattress and to permit transportation of the mattress in a compressed state for the remainder of the trip.

It would be advantageous for mattresses to be bulk packaged for shipment in such a way as to preserve their compression in spite of failures of sealing systems.

BRIEF SUMMARY OF THE INVENTION

The needs of the invention set forth above as well as further and other needs and advantages of the present invention are achieved by the embodiments of the invention described herein below.

According to one aspect of the present invention, a method for preparing mattresses for shipment includes compressing individually a plurality of mattresses, placing the plurality of compressed mattresses on a first support, placing a second support on top of the plurality of compressed mattresses, compressing further the plurality of compressed mattresses between the first support and the second support, and coupling the first support and the second support together where coupling restrains expansion of the plurality of further compressed mattresses.

In some embodiments according to the present invention, compressing individually the plurality of mattresses may include compressing individually the plurality of mattresses to a predetermined-set height. In other embodiments according to the present invention, the method may also include placing each of the plurality of mattresses within an air-impervious bag prior to compressing each of the plurality of mattresses. The air-impervious bag may be sealed after compressing each of the plurality of mattresses. An open end of the air-impervious bag may be sealed with a heated element. Prior to sealing the air-impervious bag, the air-impervious bag may be substantially evacuated.

In further embodiments according to the present invention, placing the plurality of compressed mattresses on a first support may include, but is not limited to, placing at least ten compressed mattresses on the support. Placing the plurality of compressed mattresses on a first support may also include, but is not limited to, placing twenty-two or fewer compressed mattresses on the support.

In additional embodiments according to the present invention, compressing further the plurality of compressed mattresses between the first support and the second support may include compressing the plurality of compressed mattresses to another predetermined-set height. In some embodiments according to the present invention, compressing further the plurality of compressed mattresses between the first support and the second support may include compressing with a press. In certain embodiments according to the present invention, the first support may be a shipping palette. In still other embodiments according to the present invention, the second support may be a shipping palette. In still further embodiments according to the present invention, at least one band may be placed around the first support, the second support, and the plurality of further compressed mattresses and may be tightened. The at least one band may include a steel band. Tightening the at least one band may include tightening with a steel strapping tensioner. A first and a second end of the at least one band may be coupled with a double notched steel strapping sealer. In still additional embodiments according to the present invention, exposed surfaces of the further compressed plurality of mattresses, coupled to the first support and to the second support, may covered with a wear-resistant material.

According to another aspect of the invention, a system for preparing mattresses for shipment includes means for compressing individually a plurality of mattresses, means for placing the plurality of compressed mattresses on a first support, means for placing a second support on top of the plurality of compressed mattresses, means for compressing further the plurality of compressed mattresses between the first support and the second support, and means for coupling the first support and the second support together, where the means for coupling restrains expansion of the plurality of further compressed mattresses.

In certain embodiments according to the invention, the system may include means for sealing an open end of an air-impervious bag enclosing the individual compressed mattress. The system may include means for evacuating substantially the air-impervious bag. In other embodiments according to the present invention, the system may include means for detecting compression of the individual mattress to a predetermined-set height.

For a better understanding of the present invention, together with other and further objects thereof, reference is made to the accompanying drawings and detailed description and its scope will be pointed out in the appended claims.

BRIEF DESCRIPTION OF THE DRAWINGS

For a better understanding of the present invention, reference is made to the figures, in which.

DETAILED DESCRIPTION OF THE INVENTION

The present invention relates to a method of packaging multiple bedding products using a containment container such as a crate or several shipping supports, such as, but not limited to, palettes, to further compress a stack of already individually compressed bedding products, such as, but not limited to, mattresses. Upon application of further compression, the already compressed bedding products fit within an even smaller space, allowing for cost effective transport and storage. Compression enhances transportation cost efficiency, since it is possible to use less space within a cargo container than would be required to ship conventionally vacuumed and compressed individual mattresses. A standard cargo container employed in ship, rail, highway, and air transportation contains approximately 2690 $ft^3$ in space, with a recommended 2350 $ft^3$ load volume, and is approximately 39 feet and 6 inches in length, approximately 7 feet and 9 inches in width, and approximately 8 feet and 10 inches in height. Of course, it should be realized that the present invention may be used with non-standard cargo containers as well.

In addition, restraints, such as, but not limited to, bands, associated with further compression, minimize reexpansion of the bedding products due to failure of seals associated with the packaging of individual compressed mattresses. Sealing failures may occur within a packaged individual compressed mattress or futon and result in a decompressed state, that is, expanded.

Figure 2:
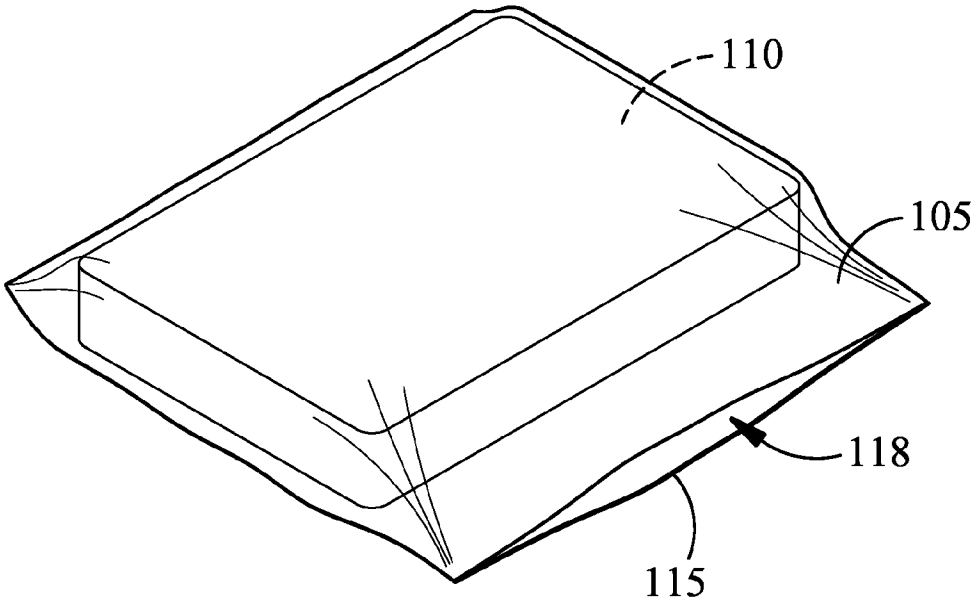
FIG. 2 (Prior Art)
FIG. 2 is a pictorial illustration of a prior art mattress enclosed within an air-impervious plastic bag.
Figure 1:
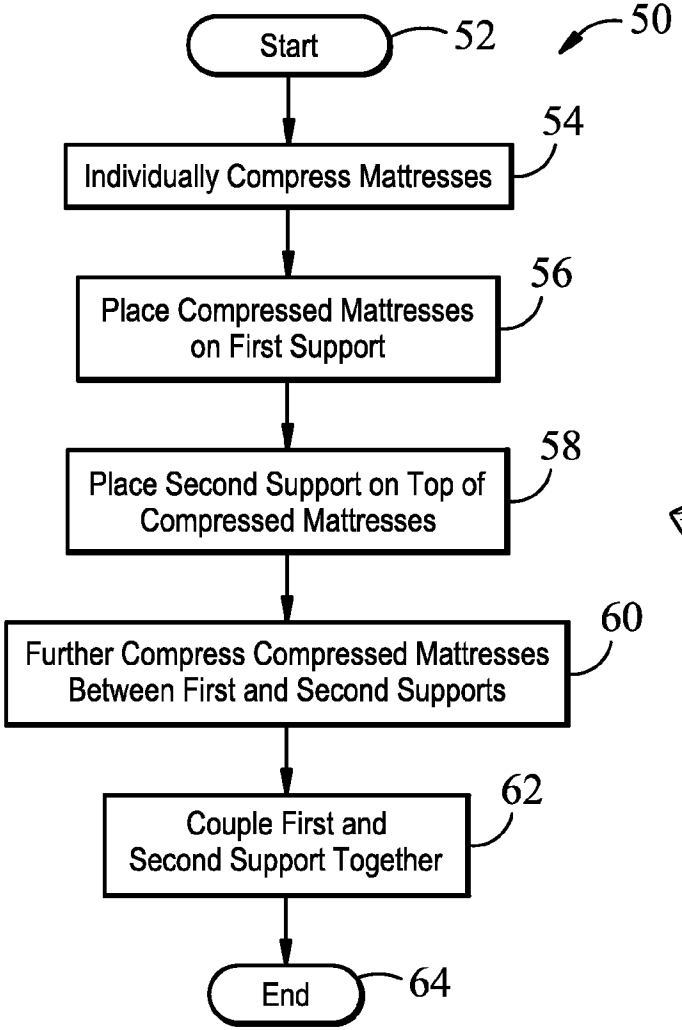
FIG. 1 is a flowchart of a method according to an embodiment of the present invention for packaging a plurality of mattresses for shipment.

FIG. 1 contains a flowchart 50 of a method according to an embodiment of the present invention for preparing a plurality of mattresses for transport. In Step 54, individual mattresses 110 are compressed and sealed. In FIG. 2, the individual mattress 110, is inserted into a bag 105 made of an air-impervious material and open at one end or side 115 in accordance with the prior art. The air-impervious bag 105 may be made of, but is not limited to, plastic, for example, polyethylene, polypropylene, or polymethyl methacrylate. Walls of the air-impervious bag 105 are sufficient to withstand subsequent pressures generated by evacuation of the air from the air-impervious bag 105 and from compression of the mattress 110, for example, approximately in the range of 0.004 to 0.006 inches thick.

Figure 3A:
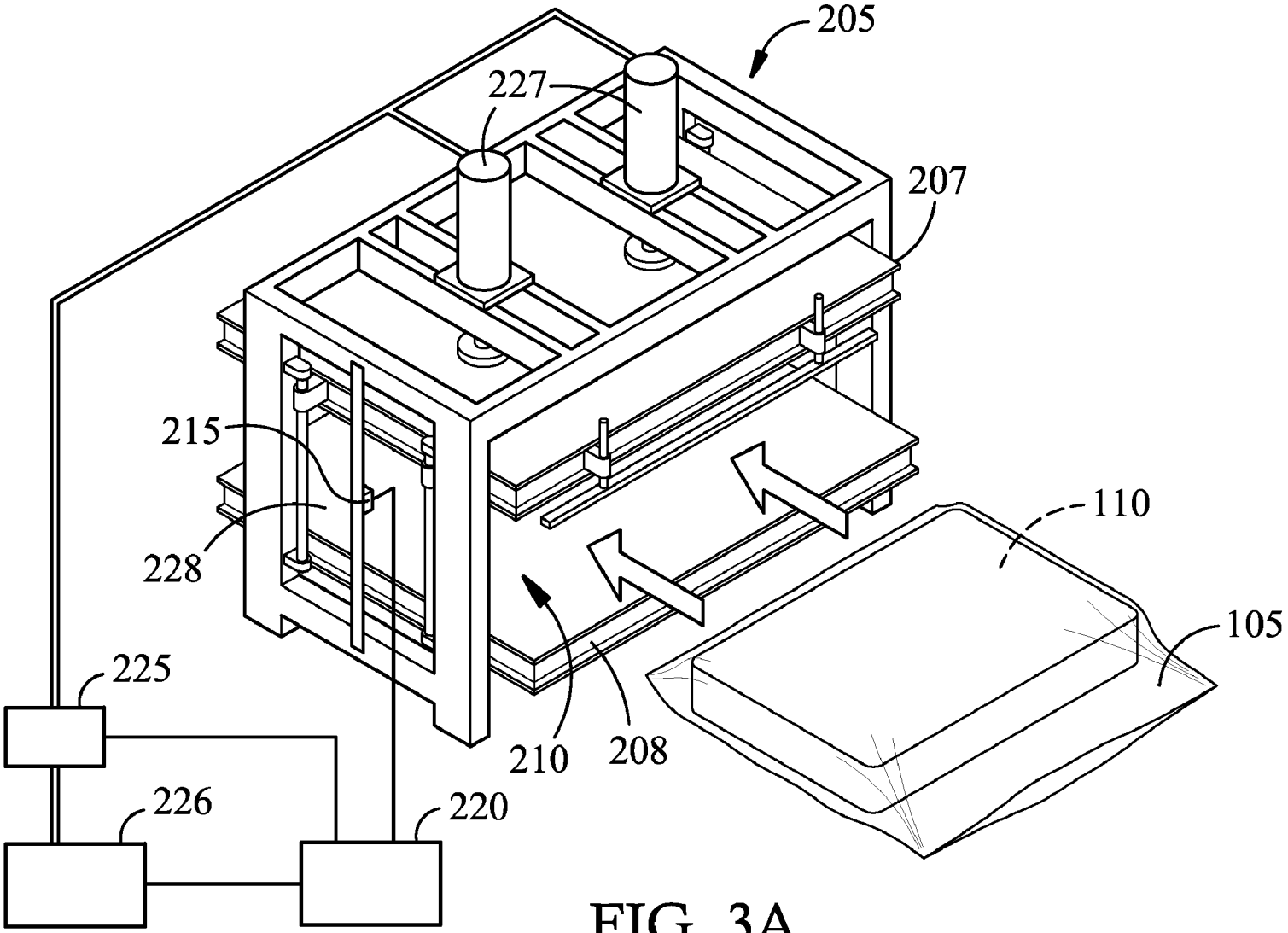
FIG. 3A is a pictorial illustration of an embodiment according to the present invention of insertion of a mattress enclosed within an air-impervious bag into a press.
Figure 3B:
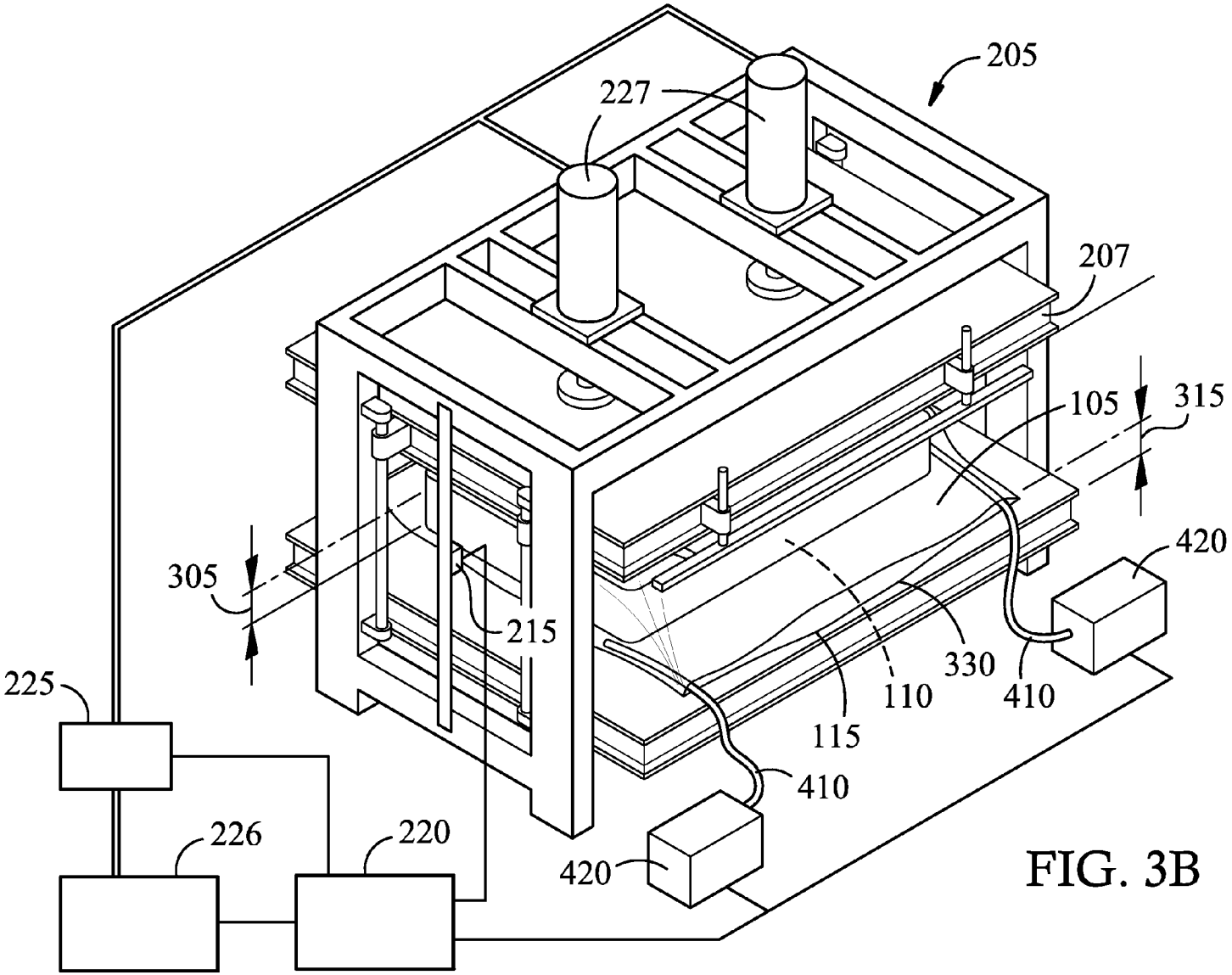
FIG. 3B is a pictorial illustration of an embodiment according to the present invention of placement of a mattress enclosed within an air-impervious bag in a press.

FIG. 3A and FIG. 3B show placement of the individual mattress 110 enclosed in the air-impervious bag 105 within a press 205 in accordance with an embodiment of the present invention. The press 205 may be, but is not limited to, an hydraulic press employing a vertical hydraulic press plate 207, as made by Jinbaoma Furniture Manufacture Co., Ltd. The press 205 comprises a position sensor 215 that is coupled to a controller 220 and that detects a position 315 of the press plate 207 at which the mattress 110 has been squeezed to a predetermined height 305. The controller 220 is coupled to at least one valve 225 controlling the flow of hydraulic fluid from a pressure source 226 to an at least one hydraulic actuator 227 coupled to the press plate 207 and capable of raising and lowering the press plate 207.

As the press plate 207 is lowered, an opening 210 between the press plate 207 and a lower press support 208 of the press 205 is reduced, thereby squeezing or compressing the individual mattress 110 resting upon the lower press support 208 and enclosed by the air-impervious bag 105 to the predetermined-set height 305. When the press plate 207 reaches the position 315 such that the opening 210 substantially corresponds to the predetermined-set height 305 of the mattress 110, a signal from the position sensor 215 to the controller 220 results in a halt to vertical movement of the press plate 207.

Compression of the individual mattress 110 is kept within the limits of the elastic structure of the individual mattress 110 and is halted before damage is done to the individual mattress 110 which may adversely affect the resilience of the individual mattress 110 and the ability of the individual mattress 110 to have its thickness restored to the precompression thickness. Typically, the thickness of an individual mattress is reduced to approximately 35% of the original uncompressed thickness. For example, although not limited thereto, an individual mattress 110 originally approximately 12 inches thick may be reduced to approximately 4 inches thick.

Figure 4A:
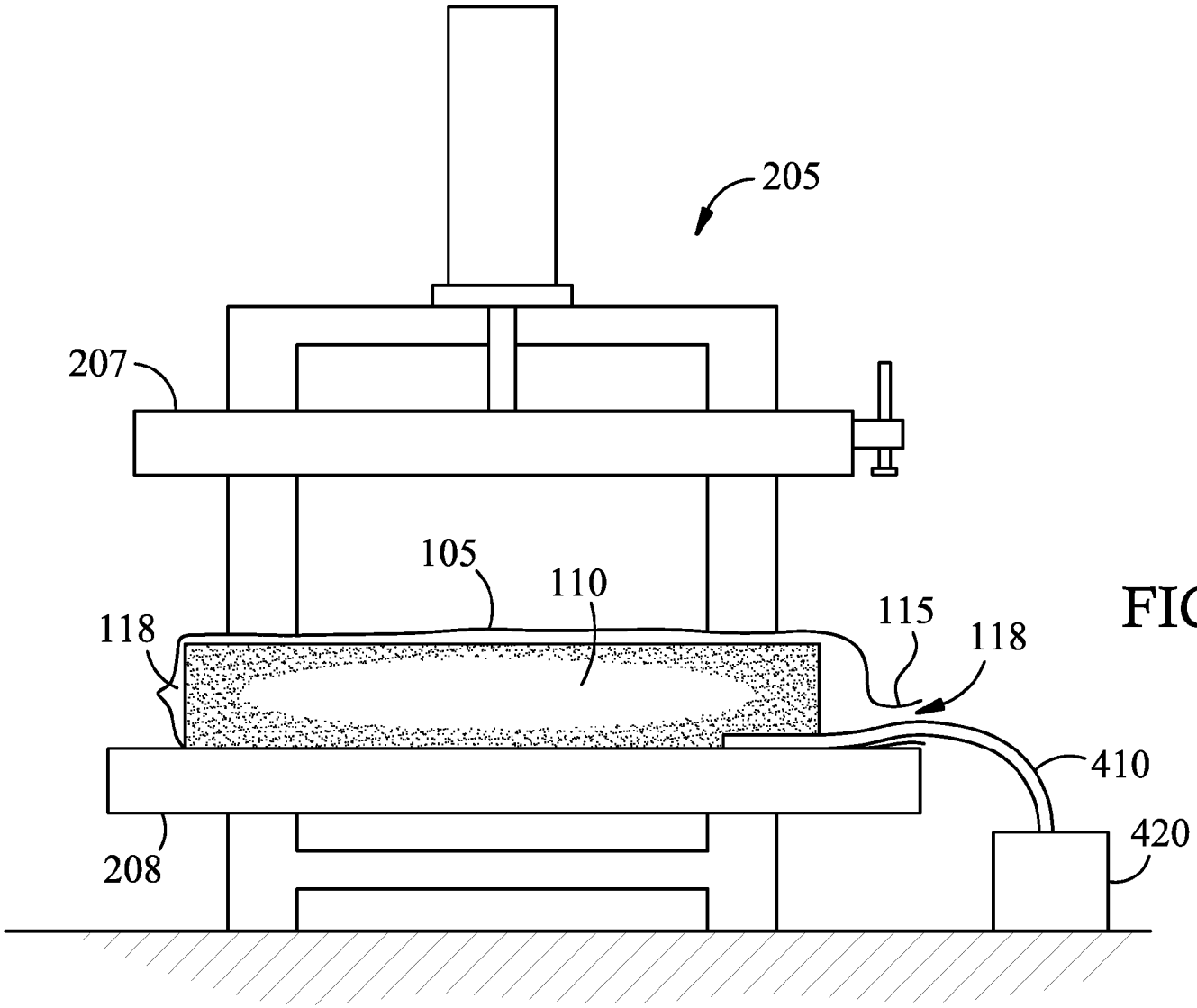
FIG. 4A is a pictorial illustration of an embodiment according to the present invention of placement of a mattress, enclosed within an air-impervious bag, in a press.

FIG. 3B and FIG. 4A show, in accordance with an embodiment of the present invention, at least one vacuum hose 410 inserted in the open side 115 of the air-impervious bag 105. The at least one vacuum hose 410 is attached to a vacuum source 420, for example, but not limited to, a transfer pump or a trapping pump, coupled to the controller 220. Air is withdrawn or evacuated from the individual mattress 110 and from the interior 118 of the air-impervious bag 105 as the mattress 110 is squeezed or compressed by the press plate 207 between the press plate 207 and the lower press support 208.

Figure 4B:
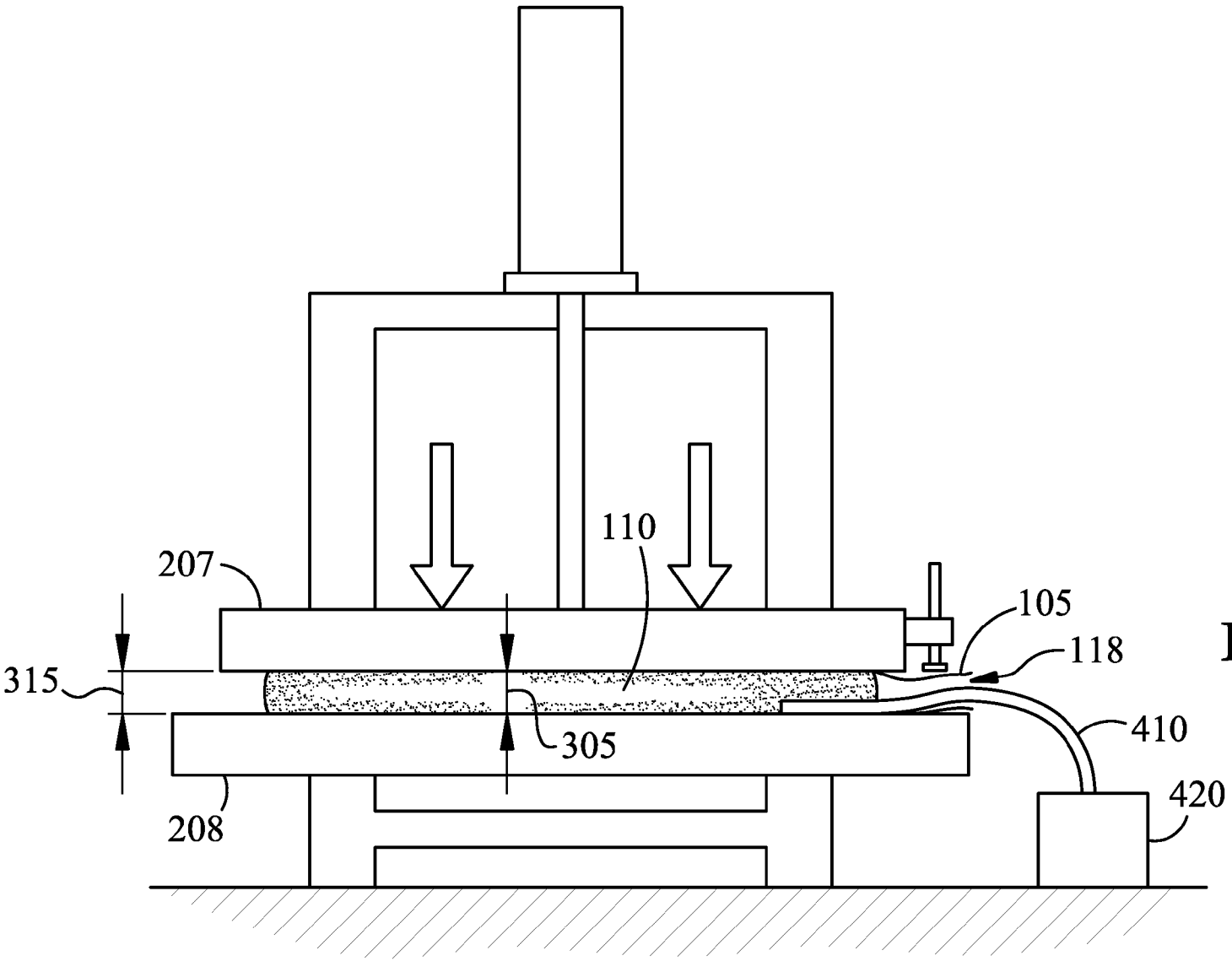
FIG. 4B is a pictorial illustration of an embodiment according to the present invention of compression of a mattress, enclosed within an air-impervious bag, in a press and evacuation of the air-impervious bag.
Figure 4C:
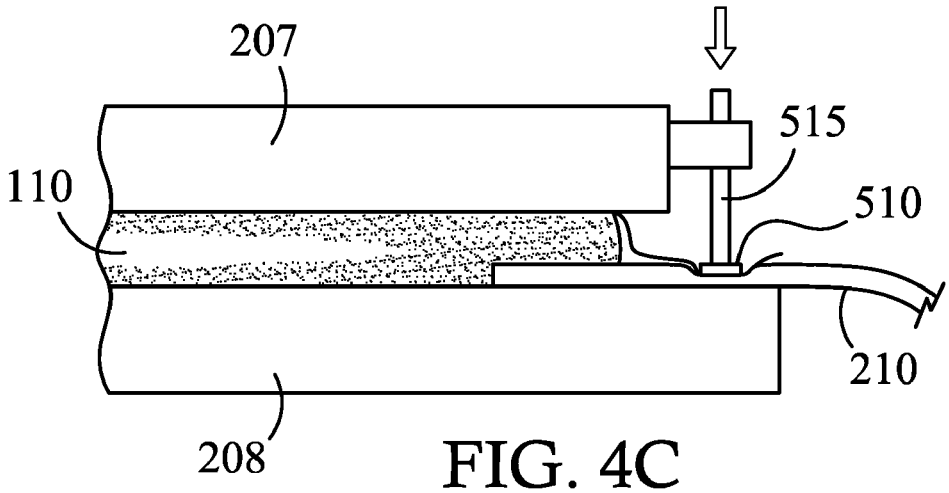
FIG. 4C is a pictorial illustration of an embodiment according to the present invention of lowering of a heated bar and partial sealing of an air-impervious bag enclosing a compressed mattress.

FIG. 4B illustrates completion of the squeezing and the evacuation of the air-impervious bag 105 to the predetermined set height 305 of the mattress 110, in accordance with an embodiment of the present invention. FIG. 4C illustrates the first stage of sealing the open end 115 of the air-impervious bag 105 to substantially preserve the evacuated interior 118 of the air-impervious bag 105, in accordance with an embodiment of the present invention. Sealing may be heat sealing and may be carried out by, but is not limited to, a press 205 including an electrically heated element or bar 510 attached to a vertical hydraulic actuator 515.

Figure 4D:
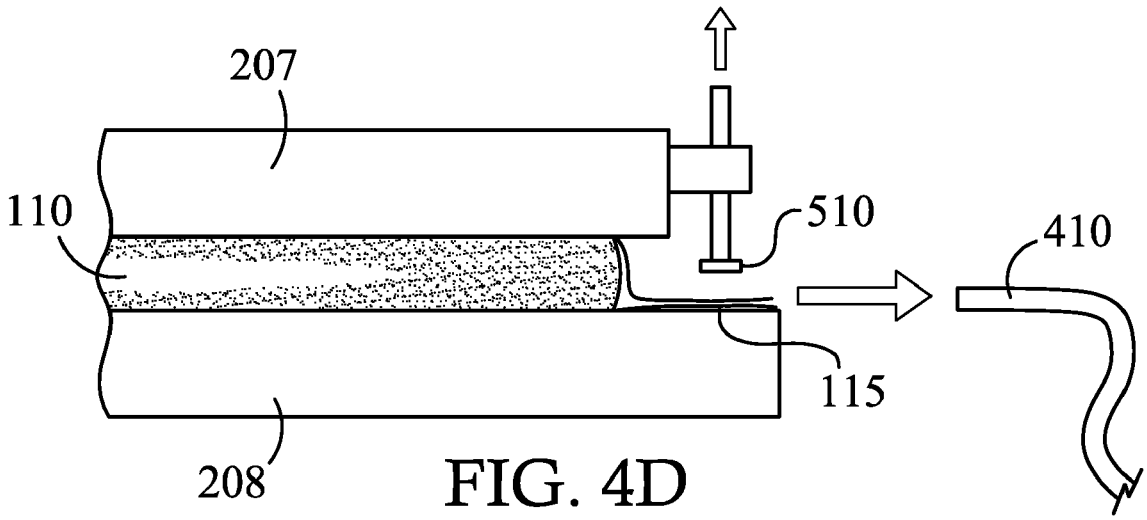
FIG. 4D is a pictorial illustration of an embodiment according to the present invention of lifting of a heated bar and withdrawal of a vacuum hose from a partially sealed air-impervious bag containing a compressed mattress.
Figure 4E:
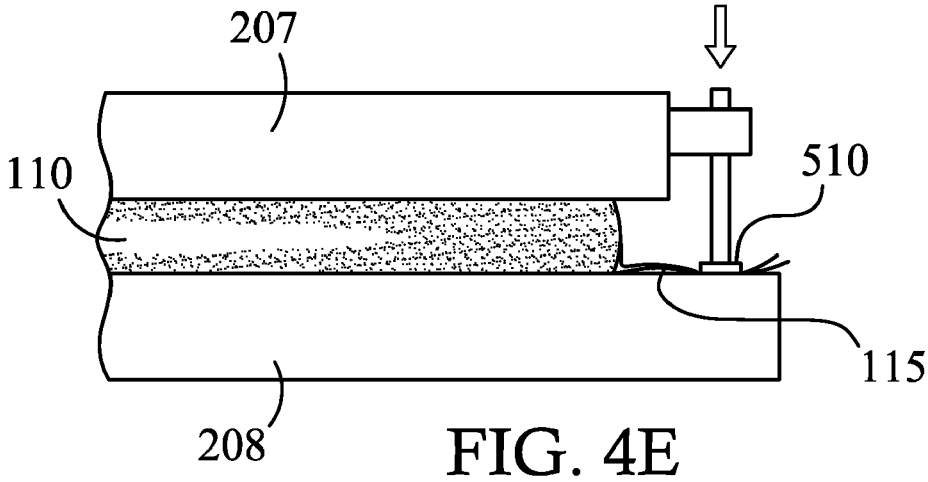
FIG. 4E is a pictorial illustration of an embodiment according to the present invention of lowering of a heated bar and completion of sealing of an air-impervious bag enclosing a compressed mattress.
Figure 5:
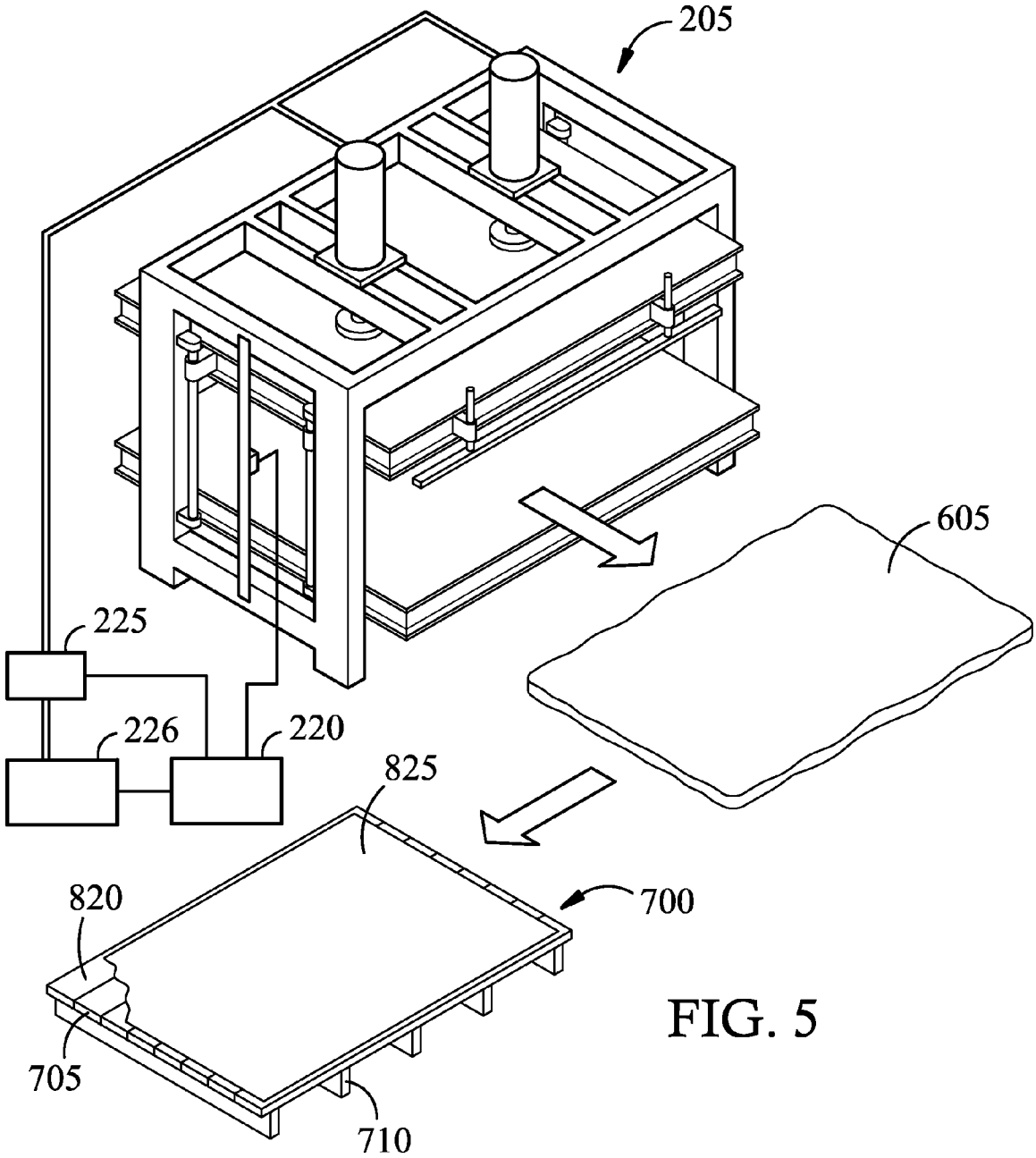
FIG. 5 is a pictorial illustration of an embodiment according to the present invention of raising of a heated bar and removal of a compressed and sealed mattress enclosed within an air-impervious bag from a press.

FIG. 4C illustrates the electrically heated bar 510 initially sealing the middle 330 (see FIG. 3B) of the open side 115 of the air-impervious bag 105 and squeezing closed the at least one vacuum hose 410, in accordance with an embodiment of the present invention. FIG. 4D illustrates the heated bar 510 being briefly lifted and the at least one vacuum hose 410 withdrawn from the interior 118 of the air-impervious bag 105, in accordance with an embodiment of the present invention. FIG. 4E illustrates, in accordance with an embodiment of the present invention, the electrically heated bar 510 being lowered again to complete the sealing of the open side 115 of the air-impervious bag 105. FIG. 5 illustrates, in accordance with an embodiment of the present invention, raising the heated bar 510 and the press plate 207 and removing the compressed or squeezed and sealed individual mattress 605 from the press 205.

Figure 6:
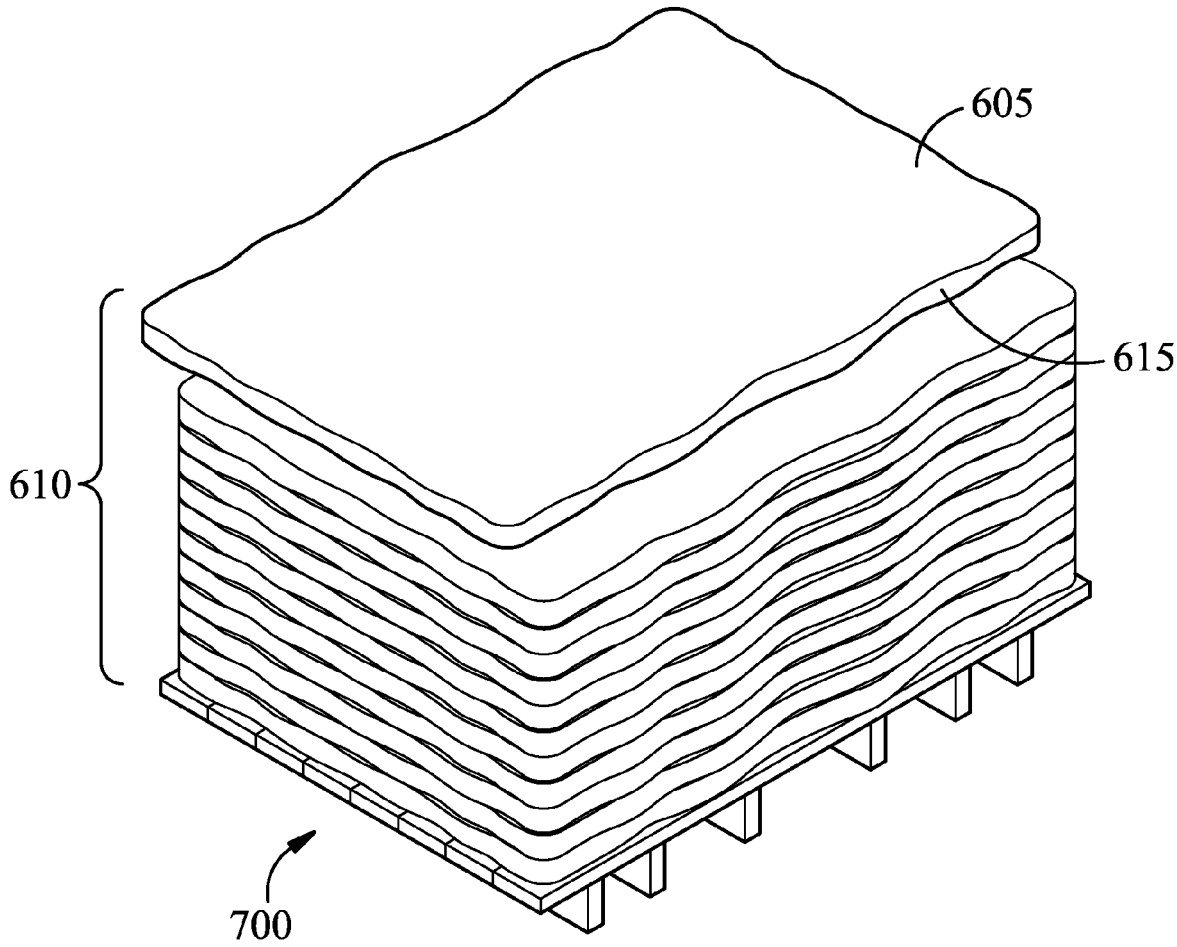
FIG. 6 is a pictorial illustration of an embodiment according to the present invention of stacking of compressed and sealed mattresses upon a lower shipping palette.

In Step 56, the compressed and sealed mattress 605 is placed on a support together with other compressed and sealed mattresses 605. FIG. 6 illustrates, in accordance with an embodiment of the present invention, placing the compressed and sealed individual mattress 605 upon a lower shipping palette or support 700 on top of and aligned with other previously compressed and sealed individual mattresses 605 in a stack 610. The top 820 of the lower shipping palette 700 may be covered with protective material 825, possibly, but not limited to corrugated cardboard. The lower shipping palette 700 may be made of an array of parallel wooden pieces 705 held in position by an orthogonal array of wooden crosspieces or crossbars 710 (see FIG. 5).

Depending upon the initial size and resilience of the individual mattresses 110, a maximum, of approximately 12 compressed and sealed individual mattresses 605, corresponding to an initially approximately 16 inch thick mattress 110, to approximately 22 compressed and sealed individual mattresses 605, corresponding to an initially approximately 8 inch thick mattress 110, may be stacked upon the lower shipping palette 700.

Although the individual compressed and sealed mattresses 605 are compressed and aligned horizontally, adjacent individual compressed and sealed mattresses 605 do not lie flat upon one another. As a consequence of their compression, individual compressed and sealed mattresses 605 have waves and bumps that create spaces between the individual compressed and sealed mattresses 605. (See FIG. 6).

Figure 7:
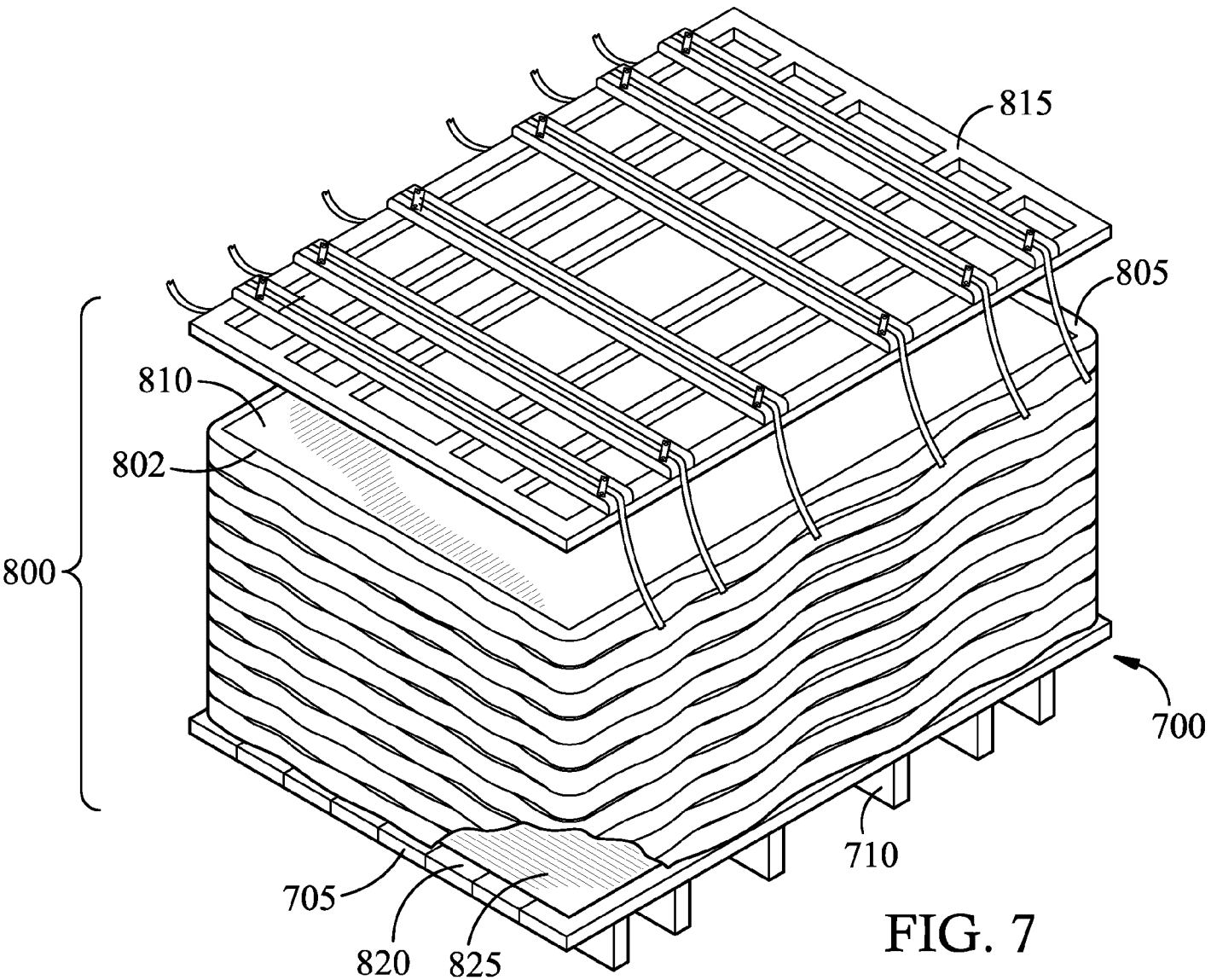
FIG. 7 is a pictorial illustration of an embodiment according to the present invention of placing of an upper shipping palette on top of a stack of compressed and sealed mattresses.

In Step 58, a second support is placed on top of the plurality of individual compressed and sealed mattresses 605. FIG. 7 illustrates, in accordance with an embodiment of the present invention, following stacking of the desired number of individual compressed and sealed mattresses 605 upon the lower shipping palette or lower shipping support 700, covering the top 805 of the uppermost individual compressed and sealed mattress 802 by a protective material 810, possibly, but not limited to, corrugated cardboard and positioning the upper shipping palette or upper shipping support 815, possibly made of wood and possibly similar in construction to the lower shipping palette 700, on top of the upper protective layer 810. Combination of the compressed and sealed individual mattresses 605, the lower shipping palette 700, and the upper shipping palette 815 forms an assembly 800.

Figure 8A:
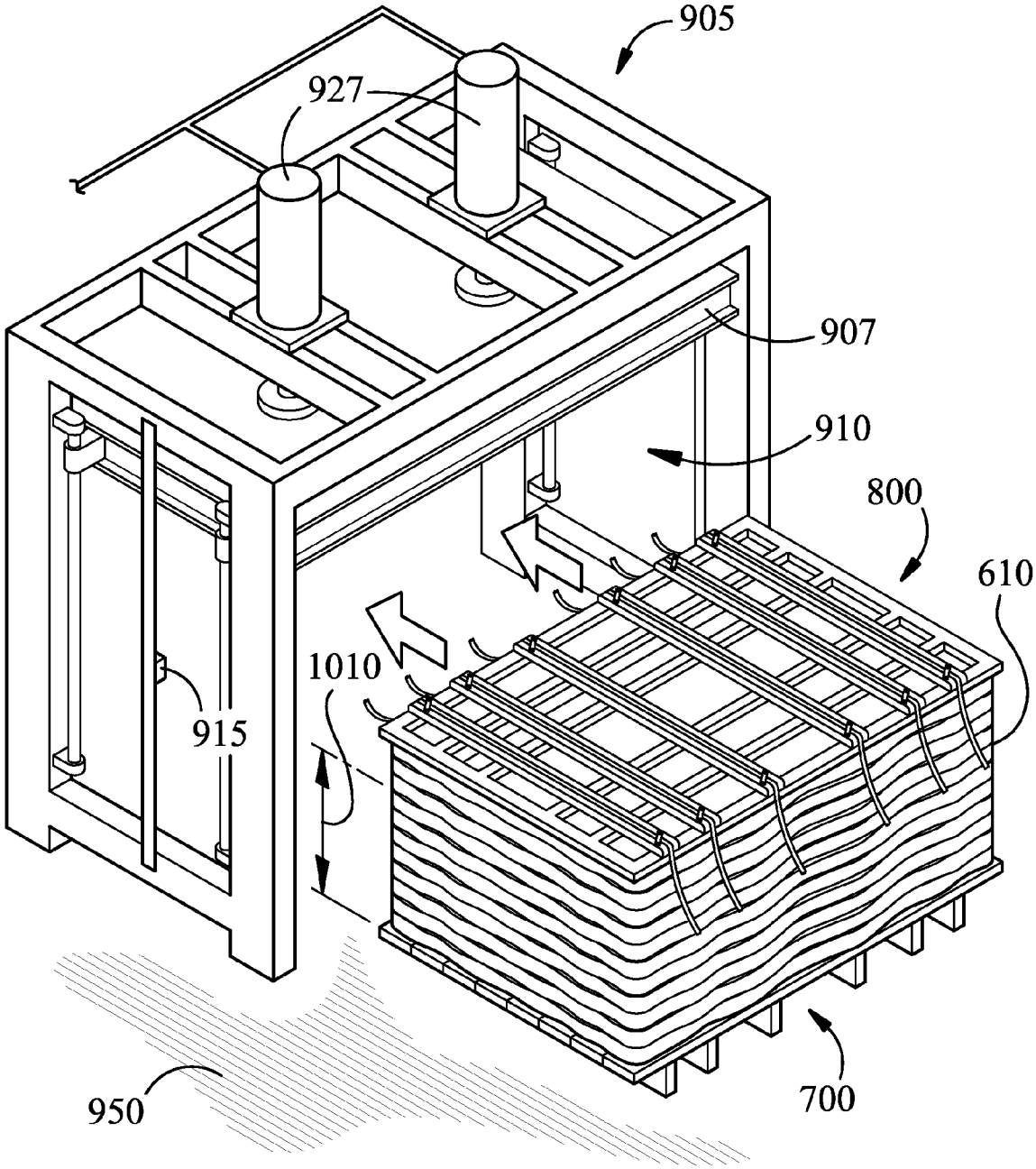
FIG. 8A is a pictorial illustration of an embodiment according to the present invention of insertion within a press of an assembly of a stack of compressed and sealed mattresses, a lower shipping palette, and an upper shipping palette.
Figure 8B:
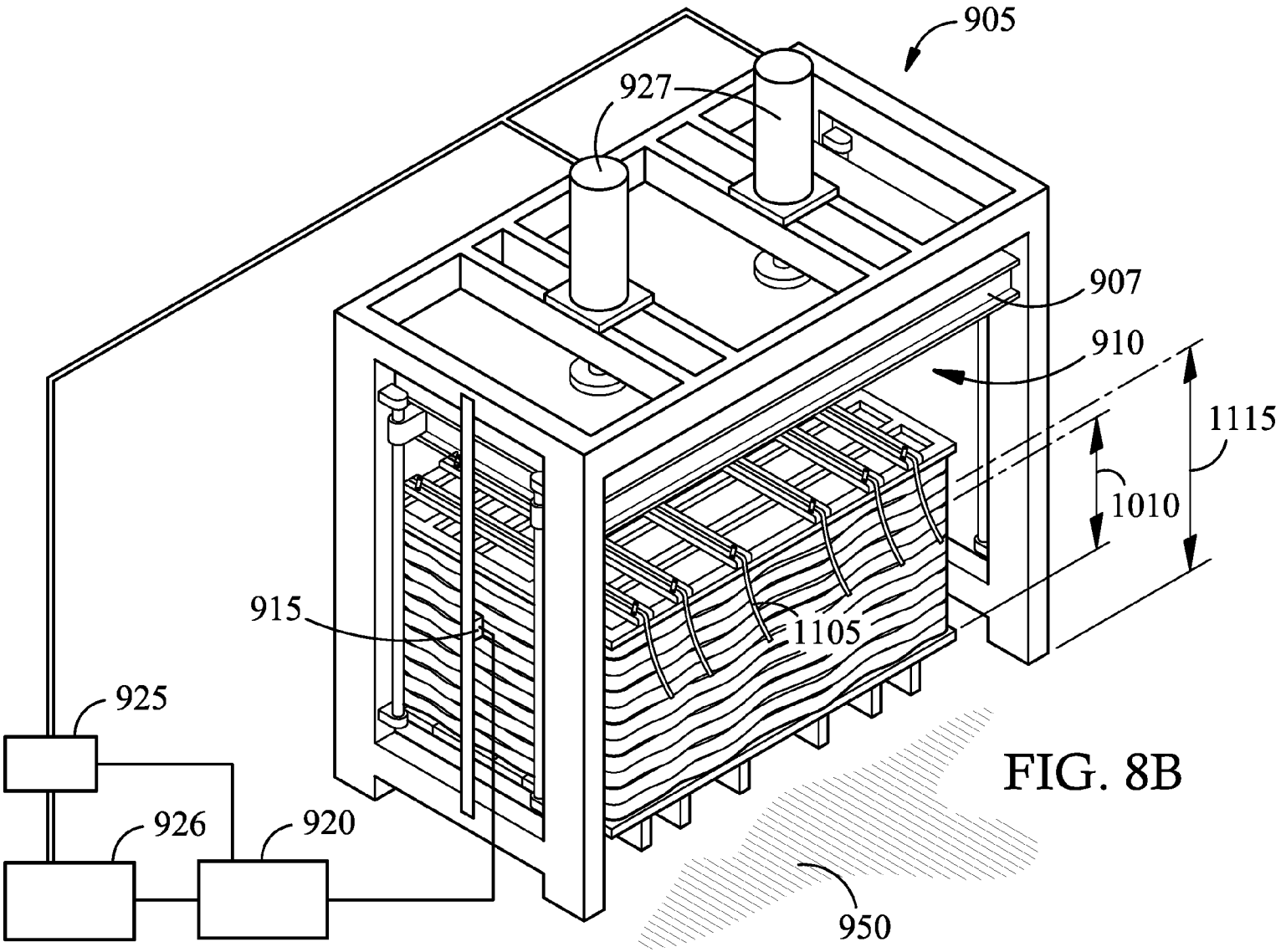
FIG. 8B is a pictorial illustration of an embodiment according to the present invention of placement within a press of an assembly of a stack of compressed and sealed mattresses positioned, a lower shipping palette, and an upper shipping palette.

In Step 60, the plurality or stack of individual compressed and sealed mattresses 605 is further compressed. FIG. 8A and FIG. 8B illustrate, in accordance with an embodiment of the present invention, placing the assembly 800 within a press 905, possibly, but not limited to, an hydraulic press, employing a vertical hydraulic press plate 907, as made by Phoenix. The press 905 comprises a sensor 915 that is coupled to a controller 920 and that detects the position of the press plate 907 when the mattress stack 610 has been squeezed to a predetermined set height 1010. The controller 920 is coupled to at least one hydraulic actuator 927, coupled to the press plate 907 and capable of raising and lowering the press plate 907.

Figure 8C:
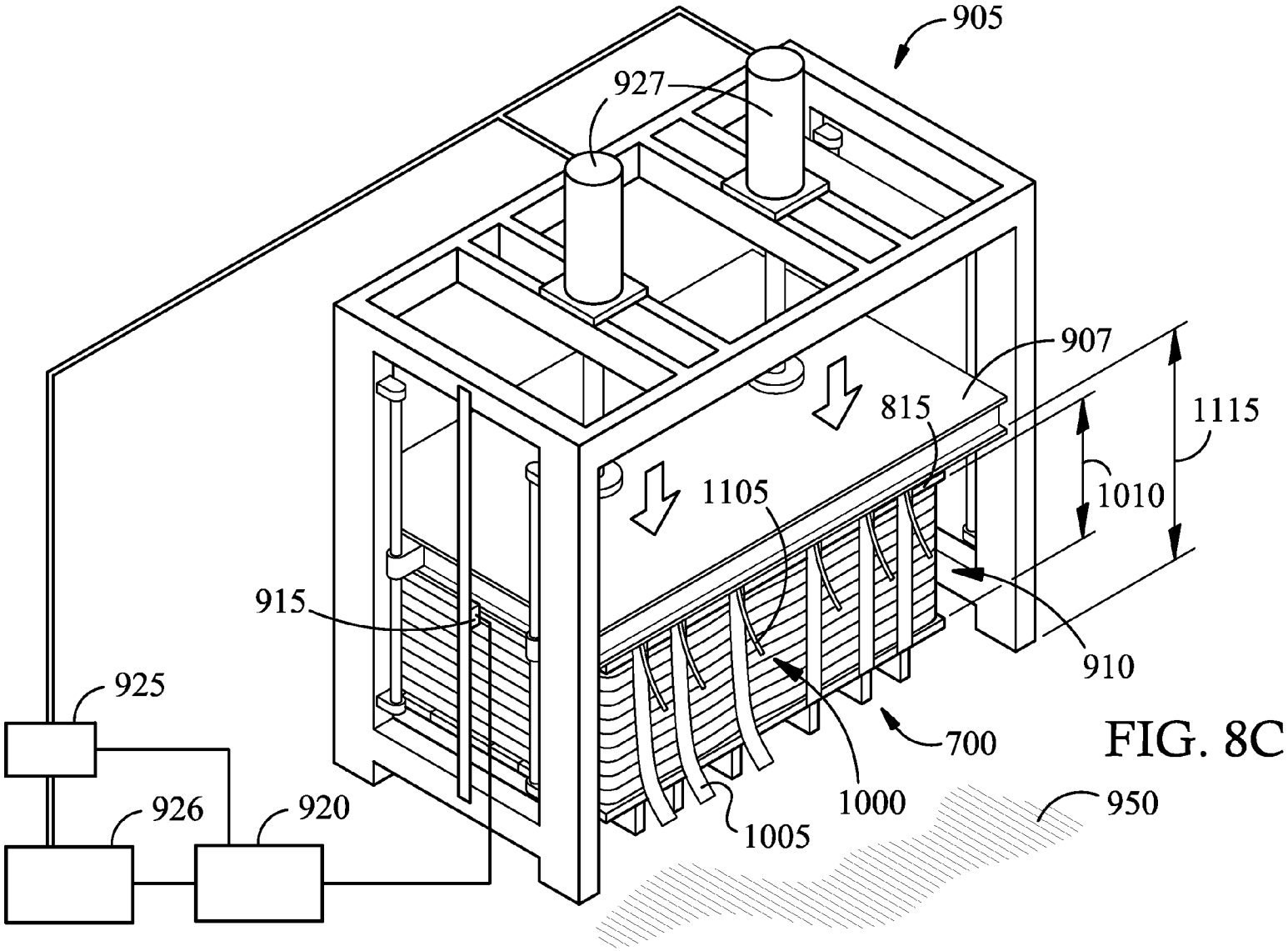
FIG. 8C is a pictorial illustration of an embodiment according to the present invention of lowering a press plate, compressing a stack of compressed and sealed mattresses to a stack predetermined-set height, and attaching of protective strips.

FIG. 8C illustrates, in accordance with an embodiment of the present invention, lowering the press plate 907 and compressing the stack 610 of individual compressed and sealed individual mattresses 605 to the stack predetermined-set height 1010. As the press plate 907 is lowered, an opening 910 between the press plate 907 and a floor 950 is reduced, thereby compressing the stack 610 resting upon the lower shipping palette 700, which, in turn, rests upon the floor 950, to the stack predetermined-set height 1010. When the press plate 907 reaches a position 1115 corresponding to the height of the stack 610 reaching the stack predetermined- set height 1010 and resulting in a compressed assembly 1000, a signal from the position sensor 915 to the controller 920 results in a halt to vertical movement of the press plate 907.

The weight of the compressed assembly 1000 is kept between substantially 1500 pounds and substantially 2000 pounds for ease of handling. The height of the compressed assembly 1000 is kept between substantially 47 inches and substantially 49 inches for ease of handling, loading, and unloading and for safety considerations, including avoidance of a propensity for tipping off when handled with a forklift during storage on a higher section of a warehouse racking system.

The compressed assembly 1000, as illustrated in FIG. 8C, should not exceed approximately 8 feet in height if to be shipped in a 40 foot Hi Cube container having an internal height of substantially 8 feet and 10 inches. For regular 40 foot containers and 20 foot containers having an internal height of substantially 7 feet and 10 inches, the compressed assembly 1000 should not exceed approximately 7 feet in height. The space left between the height of the compressed assembly 1000 and the internal height of the container may allow for ease of loading and unloading. In addition, one or more compressed assemblies 1000 may be stacked upon one another in a shipping container, provided that the total height of the stacked compressed assemblies 1000 does not exceed approximately 8 feet in the case of a Hi Cube container.

Weights and dimensions, for example, as presented above, are given as examples and may be varied within the scope of the invention.

FIG. 8C also illustrates, in accordance with an embodiment of the present invention, locking the press plate 907 in position and attaching protective strips 1005 of material, possibly, but not limited to, polyurethane foam or felt padding, to the upper shipping palette 815 and to the lower shipping palette 700. The protective strips 1005 run along the sides 615 (see FIG. 6) of the stack 610 of compressed and sealed individual mattresses 605 between the upper shipping palette 815 and the lower shipping palette 700.

Figure 8D:
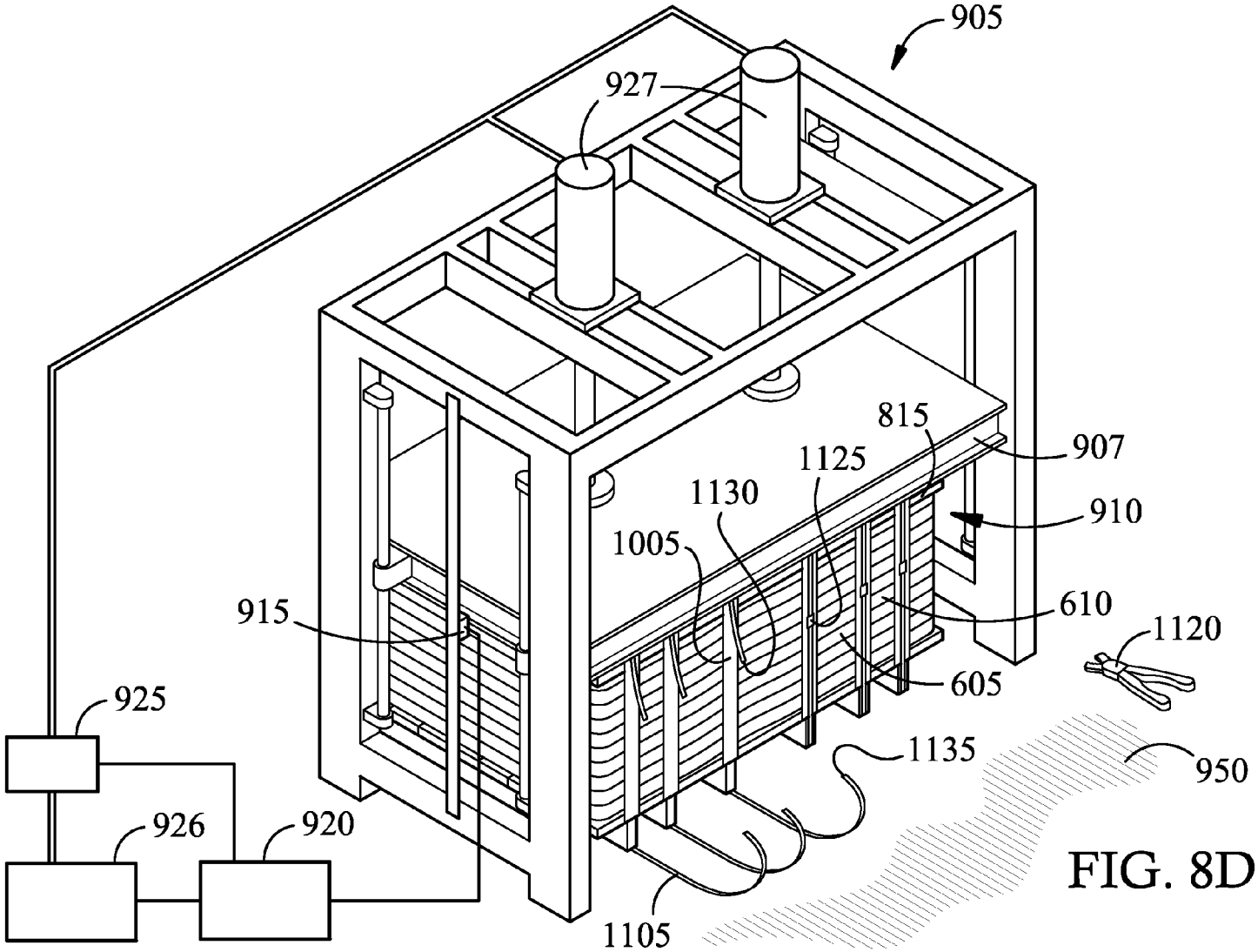
FIG. 8D is a pictorial illustration of an embodiment according to the present invention of securing bands to an assembly of a stack of compressed and sealed mattresses, a lower shipping palette, and an upper shipping palette.

FIG. 8D illustrates, in accordance with an embodiment of the present invention, preserving the height of the mattress stack 610 at the stack predetermined set height 1010, by, but not limited to, securing the upper shipping palette 815 and the lower shipping palettes 700 together. Securing may be by tightening, possibly, but not limited to, bands 1105, possibly, but not limited to steel, encompassing the lower supporting pallet 700, the mattress stack 610 of compressed and sealed individual mattresses 605, and the upper shipping palette 815.

Figure 9:
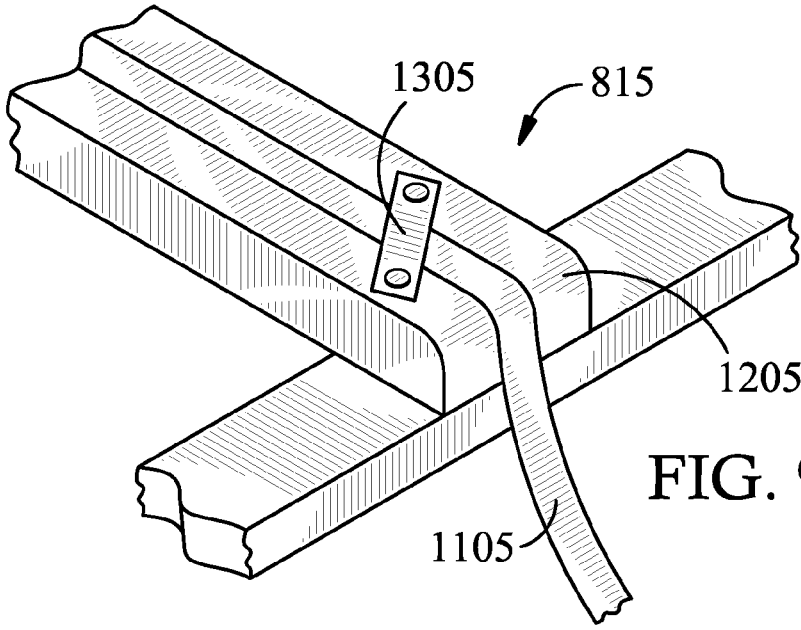
FIG. 9 is a pictorial illustration of an embodiment according to the present invention of an upper shipping palette having rounded edges and coupled to a band with a retaining clip.

FIG. 9 illustrates, in accordance with an embodiment of the present invention, rounding of an edge 1205 of the upper shipping palette 815 in contact with the band 1105 to prevent abrasion and eventual breakage of the bands 1105. Edges 1205 of the lower palette 700 may be similarly rounded. The tightened bands 1105 may be secured to the upper shipping palette 815 and to the lower shipping palette 700 by retaining clips 1305 secured to the upper shipping palette 815 and/or to the lower shipping palette 700 to prevent movement.

In Step 62, the upper support 815 and the lower support 700 are coupled together. FIG. 8D also illustrates, in accordance with an embodiment of the present invention, tightening the bands 1105 with, for example, a steel strapping tensioner 1120, and securing a first end 1130 and a second end 1135 of the band 1105, for example, with a double notched steel strapping sealer 1125. The protective strips 1005 separate the bands 1105 from contact with the individual compressed and sealed mattresses 605.

Figure 8E:
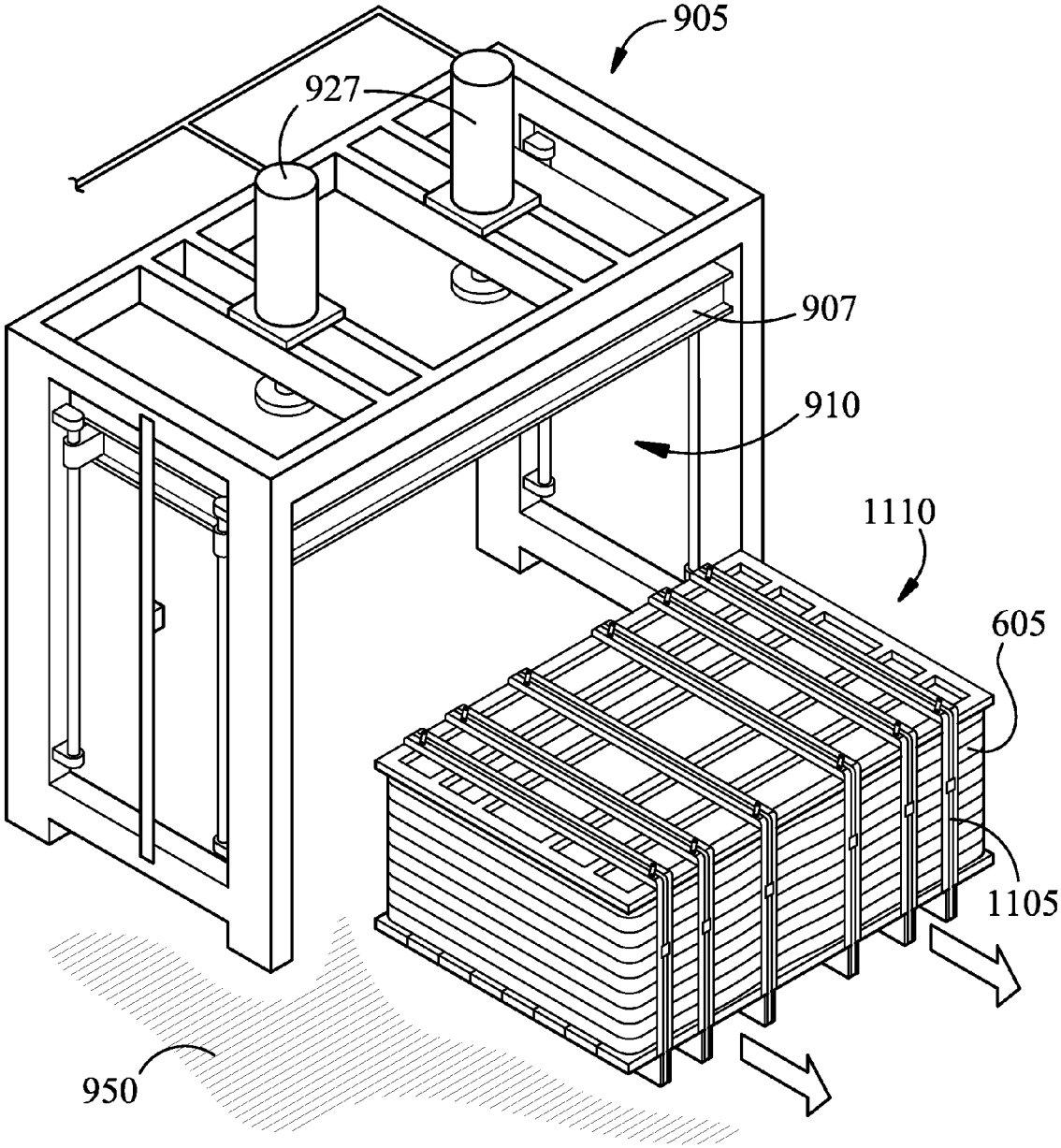
FIG. 8E is a pictorial illustration of an embodiment according to the present invention of removing a secured and compressed assembly from a press.

FIG. 8E illustrates, in accordance with an embodiment of the present invention, after the compressed assembly 1000 containing the individual compressed and sealed mattresses 605 has been secured with the bands 1105 to form the secured and compressed stack assembly 1100, raising the press plate 907 and removing the secured and compressed assembly 1110 comprised of individual compressed and sealed mattresses 605.

Figure 10:
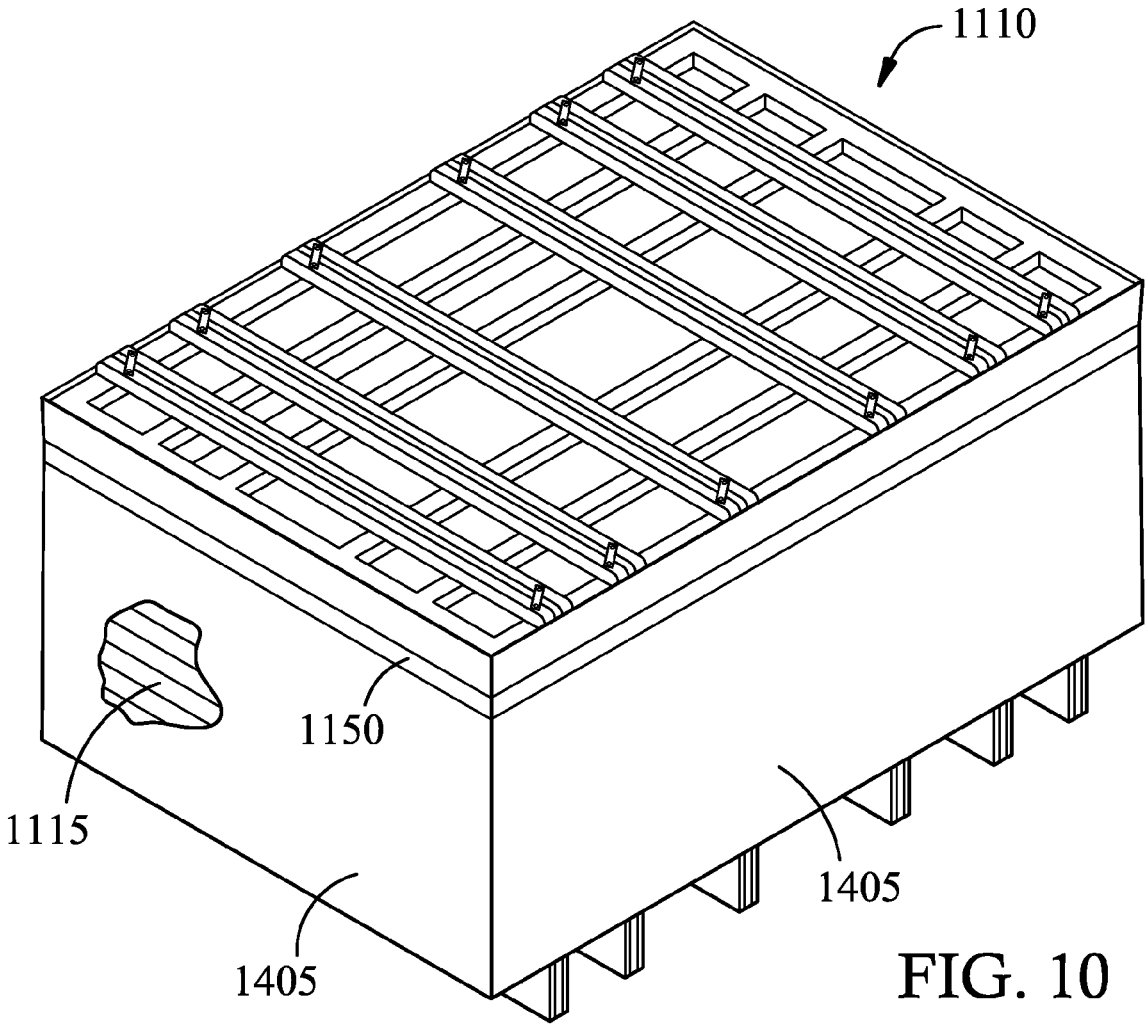
FIG. 10 is a pictorial illustration of an embodiment according to the present invention of installation of a protective layer around a compressed and secured assembly.

FIG. 10 illustrates, in accordance with an embodiment of the present invention, covering the sides 1115 of the secured and compressed assembly 1110, with at least one protective layer 1405 of wear-resistant material and securing the protective layer 1405 with a holder 1150. The protective layer 1405 may be, but is not limited to, cardboard, fabric, or a combination of cardboard and fabric.

Although the invention has been described with respect to various embodiments, it should be realized that this invention is also capable of a wide variety of further and other embodiments within the spirit and the scope of the appended claims.

What is claimed is:

1. A method for preparing mattresses for shipment, the method comprising the steps of:

compressing individually a plurality of mattresses;

retaining the compression by sealing each mattress individually;

placing the plurality of compressed mattresses on a first support;

placing a second support on top of the plurality of compressed mattresses;

compressing further the plurality of compressed mattresses between the first support and the second support; and coupling the first support and the second support together to form a stack assembly, the coupling restraining expansion of the plurality of further compressed mattresses.

2. The method of claim 1 further comprising the step of:

shipping the stack assembly from a first location to a second location.

3. The method of claim 1 further comprising the step of:

uncoupling the first support and the second support; and restoring at least one mattress to its precompression thickness.

* * * * *